US008384610B2

(12) United States Patent
Schreider et al.

(10) Patent No.: US 8,384,610 B2
(45) Date of Patent: Feb. 26, 2013

(54) ANTENNA HAVING A REFLECTOR WITH COVERAGE AND FREQUENCY FLEXIBILITY AND SATELLITE COMPRISING SUCH AN ANTENNA

(75) Inventors: Ludovic Schreider, Ville (FR); Pierre Bosshard, Tournefeuille (FR); Serge Depeyre, Blagnac (FR)

(73) Assignee: Thales, Neuilly sur Seine (FR)

( * ) Notice: Subject to any disclaimer, the term of this patent is extended or adjusted under 35 U.S.C. 154(b) by 320 days.

(21) Appl. No.: 12/820,013

(22) Filed: Jun. 21, 2010

(65) Prior Publication Data

US 2010/0321266 A1 Dec. 23, 2010

(30) Foreign Application Priority Data

Jun. 19, 2009 (FR) ..... 09 02995

(51) Int. Cl.
*H01Q 19/00* (2006.01)
*H01Q 3/02* (2006.01)

(52) U.S. Cl. ..... 343/781 P; 343/882

(58) Field of Classification Search ..... 343/777, 343/781 P, 781 R, 834, 835, 836, 878, 879, 343/880, 882, 912
See application file for complete search history.

(56) References Cited

U.S. PATENT DOCUMENTS 6,239,763 B1 * 5/2001 Cuchanski ..... 343/781 P
6,795,034 B2 * 9/2004 Lyerly et al. ..... 343/781 CA
6,859,188 B1 * 2/2005 Matthews et al. ..... 343/781 P

FOREIGN PATENT DOCUMENTS

FR 2 648 278 A1 12/1990
FR 2 853 995 A1 10/2004
WO 01/01520 A1 1/2001

* cited by examiner

*Primary Examiner* — Robert Karacsony
(74) *Attorney, Agent, or Firm* — Baker & Hostetler LLP

(57) ABSTRACT

An antenna including a reflector with coverage and frequency flexibility is provided. The antenna comprises a reversible reflector having two separate reflecting surfaces shaped geometrically so as to cover respectively a first and a second geographical zone which are different and have predetermined shapes, in which the two reflecting surfaces are fastened back to back on a common support, and at least two independent sources arranged in a fixed configuration and connected to separate radiofrequency supply chains defining different and predefined operating frequency planes, the reflector having a first deployment position, in which the focal point of the first reflecting surface is located at the phase center of the first source, and a second deployment position, in which the focal point of the second reflecting surface is located at the phase center of the second source. Application notably to the field of satellite telecommunication antennae.

5 Claims, 3 Drawing Sheets

ANTENNA HAVING A REFLECTOR WITH COVERAGE AND FREQUENCY FLEXIBILITY AND SATELLITE COMPRISING SUCH AN ANTENNA

CROSS-REFERENCE TO RELATED APPLICATIONS

This application claims priority to foreign Patent Application FR 09 02995, filed on Jun. 19, 2009, the disclosure of which is incorporated herein by reference in its entirety.

FIELD OF THE INVENTION

The present invention relates to an antenna having a reflector with coverage and frequency flexibility and to a satellite comprising such an antenna. It applies notably to the field of satellite telecommunication antennae.

BACKGROUND OF THE INVENTION

The increasing service life of telecommunications satellites and the change in the requirements linked to the various missions which may be entrusted to them make it necessary for the payloads, and particularly the antennae, of future generations of satellites to be flexible. This flexibility may be implemented in terms of the geographical coverage zone of the antenna, and/or in terms of the polarization and/or the operating frequency band. This flexibility is not intended to cover all the geographical coverage zones simultaneously, but, instead, to have a choice between a plurality of geographical coverages capable of being generated by the same antenna and to make it possible to modify the satellite's mission in orbit.

The antennae placed on board satellites typically comprise a geometrically shaped reflector illuminated by a single source in order to cover a coverage zone aimed at the Earth. A satellite generally comprises a transmission and reception antenna or a transmission antenna and a reception antenna per coverage zone. The geometrical shape of the reflector may, where appropriate, be defined so as to be optimized for a plurality of orbital positions of the satellite, but, in general, so as to cover a single geographical coverage.

Frequency flexibility over a broad-band spectrum, for example the frequency plane Ku, Ku+ covering the frequencies between 10.7 GHz and 18.4 GHz and a single coverage zone, cannot be obtained by means of a single source, since, at the present time, no source has a sufficiently broad band. Furthermore, there is a critical point regarding the diplexing between the transmission and reception bands, and it is necessary to preserve an allowance of the order of 250 MHz between the high frequency of the transmission band and the low frequency of the reception band.

A first known solution is to use two separate antennae in order to cover the same geographical zone, but this solution presents problems of mass, of bulk and of cost.

A second known solution involves placing two sources side by side in front of an over-dimensioned reflector, so as to minimize the defocusing of the two sources. The phase centers of the two sources are located in the focal plane of the reflector, and their radiation axes are parallel. The two sources are positioned as near as possible to the focal point of the reflector in order to reduce the defocusing of the sources and the directivity losses of the antenna which arise as a result. However, this solution is not optimal.

As an example, one reference discloses an antenna device comprising two sources and a pivotable auxiliary reflector provided with two reflecting surfaces. On the one hand, this device has the abovementioned defocusing disadvantages, thus impairing the performances of the antenna, and, on the other hand, the number of degrees of freedom accessible on an auxiliary reflector is relatively low, which amounts to limiting the deformation possibilities of the coverage obtained by means of the antenna beam.

Another possibility involves using a single source located at the focal point of a reflector, the source being connected to a complex electrical architecture combining two radiofrequency chains, the first chain operating in a first frequency plane and the second chain operating in a second frequency plane. However, this architecture entails a complexity which gives rise to appreciable ohmic losses and a high implementation cost.

Moreover, in order to produce two separate coverage zones, the present solutions make it necessary to use two separate and independent antennae, each comprising a deployable reflector, and the reflector has to be linked to two different sources in order to cover a selected frequency band completely, thus making it necessary to have a total of four sources placed on a side face of a satellite, and a double stacking system for deploying or stowing the two reflectors of the two antennae.

Another reference describes another solution involving using a reversible reflector comprising two reflecting surfaces covering two different coverage zones, the reflector being linked to a single source. Positioning one of the reflecting surfaces in front of the source makes it possible to select one of the coverage zones, but this solution does not have any frequency flexibility and does not make it possible to operate in a broad-band frequency plane.

SUMMARY OF THE INVENTION

Embodiments of the present invention advantageously produce an optimal antenna making it possible to satisfy the coverage and frequency flexibility requirements, making it possible to eliminate the aberrations and losses attributable to defocusing, which are simple to implement and the geometry of which does not result from a compromise in terms of performances and makes it possible to reduce the ohmic losses, as compared with prior solutions.

In this regard, one embodiment of the present invention provides an antenna, with coverage and frequency flexibility, that comprises a reversible reflector having two separate reflecting surfaces shaped geometrically so as to cover respectively a first and a second geographical zone which are different and have predetermined shapes, in which the two reflecting surfaces are fastened back to back on a common support, and at least two independent sources arranged in a fixed configuration and connected to separate radiofrequency supply chains defining different and predefined operating frequency planes, the reflector having a first deployment position, in which the focal point of the first reflecting surface is located at the phase centre of the first source S1, and a second deployment position, in which the focal point of the second reflecting surface is located at the phase centre of the second source S2.

Thus, whatever the configuration in which the antenna according to the invention is used, the active source S1 or S2 is focused, since its phase centre is positioned at the focal point of the reflector.

Advantageously, the antenna comprises means for deploying the reflector, comprising at least one first motor, and means for reversing the reflector, comprising at least one second motor, the two motors having axes of rotation perpendicular to one another, the second motor actuating the reversal of the reflector from the first position to the second position by means of a rotation of the common support through a predetermined angle.

Advantageously, the reflector comprises a third deployment position, in which the focal point of the first reflecting surface is located at the phase centre of the second source, and a fourth deployment position, in which the focal point of the second reflecting surface is located at the phase centre of the first source.

Advantageously, the antenna comprises, furthermore, means for the translation of the reflector, comprising a third motor connected to the first motor and to the second motor by means of lever arms, the third motor having an axis of rotation parallel to the axis of rotation of the first motor, the first and the third motor which actuate the reflector in translation making it possible to change the position of the focal point of the first reflecting surface or of the second reflecting surface from the first source to the second source. The antenna according to the invention thus benefits from specific kinematics, notably by virtue of the expediently placed three motors, and makes it possible to achieve optimal RF performances on two separate coverages and on two different frequency planes.

According to one embodiment, the antenna comprises a single reflector, this reflector being the reversible reflector. A large number of different coverages can thus be produced (although, ultimately, only two coverages are accessible on the reflector), for example highly deformed and highly elongated geographical coverages.

According to another embodiment, the antenna comprises a main reflector associated with an auxiliary reflector (for example, an antenna with a Cassegrain-type set-up). In this case, preferably, the main reflector comprises two reversible reflecting surfaces, so as to profit from maximum degrees of freedom in producing the coverages.

Advantageously, the sources may be fastened side by side or one above the other.

The invention also relates to a telecommunications satellite comprising such an antenna.

BRIEF DESCRIPTION OF THE DRAWINGS

Other particulars and advantages of the invention will become clearly apparent from the rest of the description given by way of purely illustrative and non-limiting example, with reference to the accompanying diagrammatic drawings in which.

DETAILED DESCRIPTION

Figure 1A:
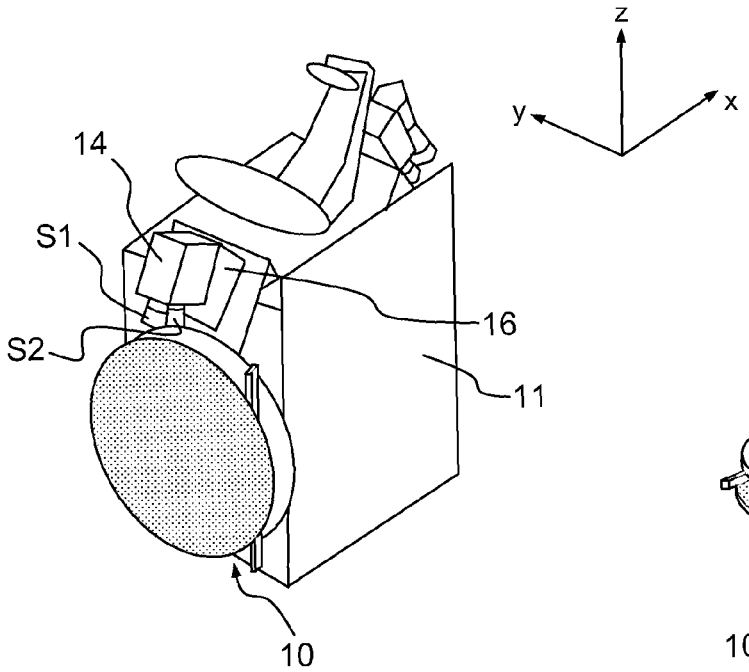
FIG. 1*a* shows a perspective diagram of an antenna having a reflector with coverage flexibility, mounted on the platform of a satellite, the reflector being in a stowed position, according to an embodiment of the present invention.
Figure 1B:
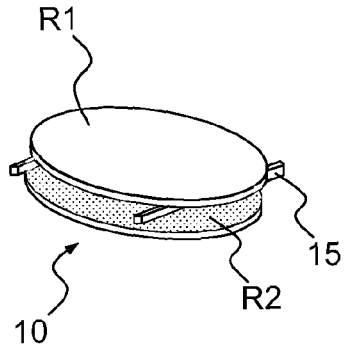
FIG. 1*b* shows a perspective diagram of the reflector in the deployed position, showing the two reflecting surfaces of the reflector which are mounted on a common support, according to an embodiment of the present invention.

In the example illustrated in FIG. 1*a*, the offset simple passive antenna comprises a reflector 10 in the stowed position on the platform 11 of a satellite, for example on a side face parallel to a plane YZ, and two independent sources S1, S2 of radiofrequency signals. A deployment mechanism 12, which can be seen in the following figures, makes it possible to deploy the reflector 10 so that, in a deployed position, the two sources S1, S2 are arranged in front of the reflector in the focal plane of the latter. The reflector 10 comprises two separate reflecting surfaces R1, R2 having different shapes and fastened back to back on a common support 15, as illustrated, for example, in FIG. 1*b*. Each reflecting surface is shaped geometrically and optimized for a given mission so as to illuminate a ground coverage zone having predetermined dimensions when a single source is located at its focal point. This shape has approximately the configuration of a parabola and differs from this only slightly. The sources S1, S2, for example of the horn type, are fastened on an inclined plane 16 formed on the platform 11 and are arranged in a predetermined fixed configuration, for example one beside the other. The sources S1 and S2 may in some cases be placed one above the other or in any other configuration.

In the deployed position, one of the reflecting surfaces R1, R2 is positioned opposite the two sources S1, S2 and is oriented in a predetermined aiming direction 17. The reflector 10 is reversible with respect to the plane of the support 15 as a result of a rotation of the assembly consisting of the support 15 and of the two reflecting surfaces R1, R2, thus making it possible to be able to change the reflecting surface and therefore the desired coverage zone. The invention therefore involves positioning the two reflecting surfaces R1, R2 on the common support 15 in such a way that, in a first position of the reflector 10 corresponding to a first mission of the satellite, the phase centre of the source S1 is located at the focal point of the first reflecting surface R1, and in such a way that, in a second position of the reflector obtained by means of a rotation of the reflector and corresponding to a second mission of the satellite, the phase centre of the second source S2 is located at the focal point of the second reflecting surface R2. The rotation making it possible to reverse the reflector from the first position to the second position is carried out about an axis 22 parallel to the plane of the support 15 and through a predetermined angle depending on the relative positioning of the reflecting surfaces R1, R2 on the support 15. As a non-limiting example, the angle of rotation for reversing the reflector is adjustable within a predetermined value range, for example between 175° and 195°.

The mechanism for deploying the reflector comprises, for example, a motor M1 having an axis of rotation parallel to the plane YZ and a deployment arm 13 capable of being actuated in rotation by the motor M1 between a position in which the reflector 10 is stowed against the wall of the platform 11, parallel to the plane YZ of the satellite, and a deployment position. The mechanism for reversing the reflector 10 comprises, for example, a second motor M2 having an axis perpendicular to the axis of the motor M1 and connected to the deployment arm 13 and to the reflector 10. The second motor M2 actuates the reversal of the reflector 10 from the first position to the second position by means of a rotation of the common support 15 through a predetermined angle.

The two sources S1, S2 are supplied respectively by means of two different chains 2, 3 for the supply of radiofrequency signals RF, which are preferably integrated in a housing 14. Since each RF chain 2, 3 is dedicated to telecommunication functions, the two sources 51, S2 can be supplied in different frequency planes F1 and F2, each frequency plane being capable of comprising one or more transmission and/or reception frequency sub-bands.

Figure 2A:
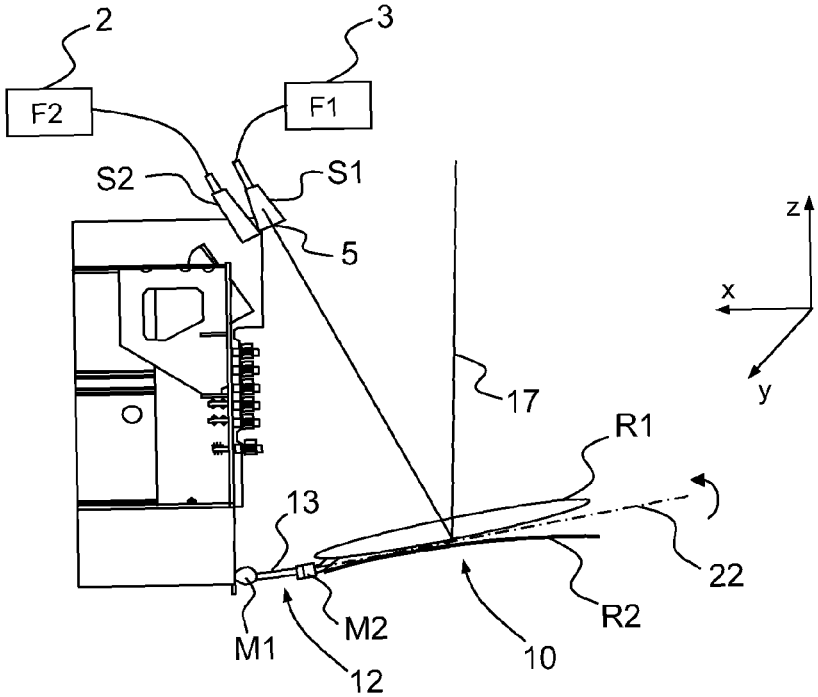
FIGS. 2*a* and 2*b* show two diagrams of the same antenna for two different aiming directions, according to an embodiment of the present invention.
Figure 2B:
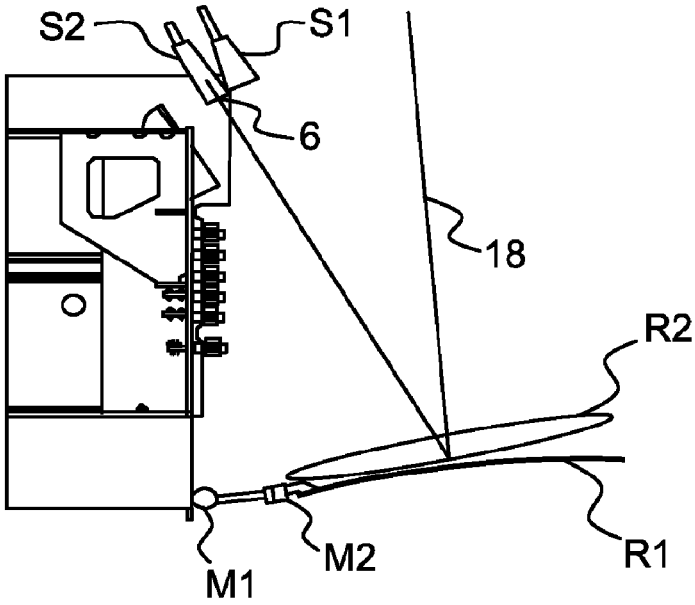

In FIG. 2*a*, the phase centre 5 of the source 51 is positioned in the focal point of the first reflecting surface R1 which is aimed in a first aiming direction 17 located on a first ground coverage zone corresponding to a first predetermined mission. In FIG. 2*b*, the phase centre 6 of the source S2 is positioned at the focal point of the second reflecting surface R2 which is aimed in a second aiming direction 18 located on a second ground coverage zone different from the first coverage zone and corresponding to a second predetermined mission. The change from the first mission to the second mission is carried out by means of a rotation of the reversible reflector 10 through a predetermined angle, for example of 180°, with respect to the plane of the support 15. The drive of the reflector 10 in rotation is carried out by means of the second motor M2. The desired change in aiming direction between mission 1 and mission 2 determines the relative position of the two reflecting surfaces R1, R2 with respect to one another on the support 15.

In addition to the coverage flexibility obtained by the reversal of the reflector 10, it is possible to obtain frequency flexibility on the same coverage zone and therefore for the same position and same aiming direction of the reflector, without losses or aberrations attributable to defocusing. For this purpose, the invention involves selecting one of the sources S1 or S2 as a function of the desired frequency, then displacing and orienting the reflector 10 in such a way that the selected source is positioned at the focal point of the reflector and that the reflector illuminates the selected coverage zone.

Figure 3A:
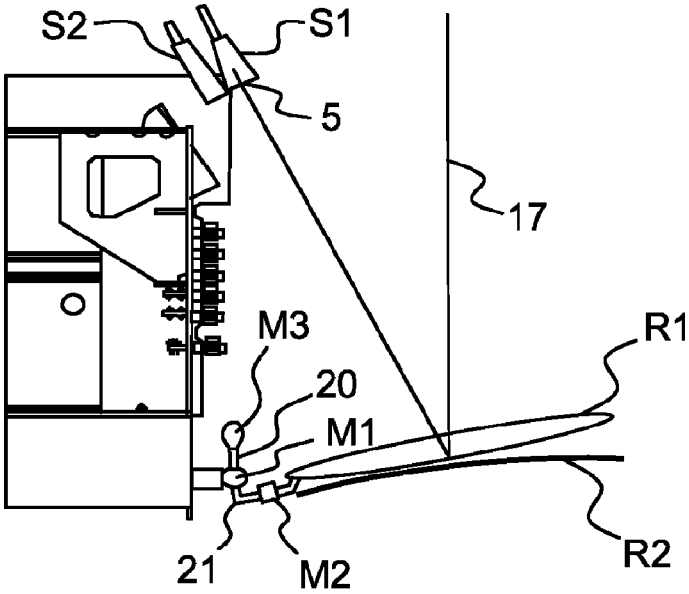
FIGS. 3*a* and 3*b* show two diagrams of the same antenna in a second and a third position in which respectively the source S1 and the source S2 are at the focal point of the reflector aimed in the same direction, according to an embodiment of the present invention.
Figure 3B:
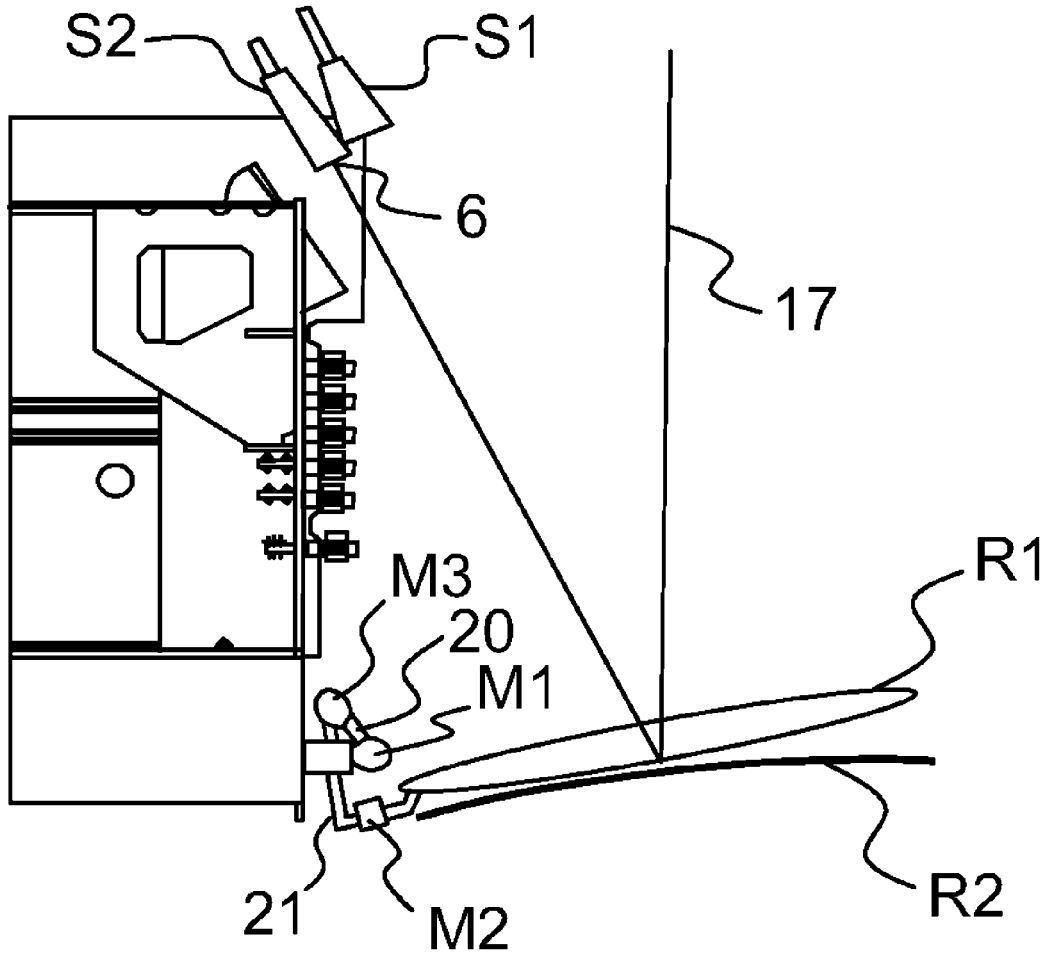

In the initial configuration illustrated in FIG. 3*a*, the phase centre 5 of the source S1 is positioned at the focal point of the first reflecting surface R1 of the reflector 10 which is aimed in an aiming direction 17 located, for example, on the terrestrial equator. If the source S1 is supplied, for example, in a frequency plane F1 by means of a first RF chain, and the source S2 is connected to a second RF chain optimized for operating in a frequency plane F2, in order to change from the frequency plane F1 to the frequency plane F2 without any change in the aim of the antenna, the invention involves switching the supply of the source S1 to the source S2 and displacing the reflector in translation from the source S1 towards the source S2 in order to position the focal point of the first reflecting surface R1 at the phase centre 6 of the source S2, as illustrated in FIG. 3*b*. The displacement and orientation of the reflector 10 in front of the source S2 without any change in the aiming direction 17 of the antenna can be carried out, for example, by means of two motors M1, M3, the motor M3 being connected to the motor M1 and to the motor M2 by means of corresponding lever arms 20, 21. The two motors M1, M3 have axes of rotation parallel or virtually parallel to one another and virtually parallel to the plane YZ of the side face of the platform 11 of the satellite which supports the reflector 10. The actuation of the motor M1 in anti-clockwise rotation and at an angle of rotation depending on the spacing between the sources S1 and S2 drives the first lever arm 20 in rotation in the same direction, the effect of which is to displace the motor M3 and reflector 10 and to bring them closer to the platform 11 of the satellite, as shown in FIG. 3*b*, and thus to displace the reflector from the source S1 towards the source S2. The actuation of the motor M3 in clockwise rotation at the same angle of rotation as the motor M1 then makes it possible, by means of the lever arm 21, to swing the reflector 10 in rotation in the other direction, until it is in a position parallel to its initial position and until the phase centre 6 of the source S2 is thus positioned at the focal point of the reflector 10 and illuminates the same ground coverage zone. The successive rotations of the various motors M1 and M3 thus cause the reflector 10 to undergo a translation such that the focal point of the reflecting surface R1 changes from the source S1 to the source S2. Using a number of sources greater than two, the same operations can be reproduced with one or more additional sources, for example in order to carry out one or more other missions in other frequency planes, if each of the additional sources is connected to a dedicated RF chain optimized through a frequency plane other than that of the sources S1 and S2.

With a single antenna comprising two interchangeable reflecting surfaces, three motors and two sources S1, S2, it is thus possible to deploy the antenna in orbit, and to position it so as to perform selectively one of four possible missions. Since the two reflecting surfaces are interchangeable and fixed together mechanically, the four different missions are performed, using a single mechanical support and deployment structure. The first mission is carried out by placing the focal point of the reflective surface R1 at the phase centre 5 of the first source S1, for the second mission the reflector is moved in translation and the phase centre 6 of the second source S2 is at the focal point of the reflecting surface R1, for the third mission the reflector is rotated through a predetermined adjustable angle, for example of between 175° and 195° in the exemplary embodiments, and the first source S1 is at the focal point of the reflecting surface R2, and, for the fourth mission, the second source S2 is at the focal point of the reflecting surface R2.

By virtue of the three motors, it is thus possible to focus the sources S1 or S2 at the focal point of one of the reflecting surfaces R1, R2 of the reflector 10, thus making it possible to obtain optimal performances over the entire frequency plane. By additional sources being added, additional missions in different frequency planes likewise become possible.

Although the invention has been described in connection with particular embodiments, it is quite clear that it is in no way limited to these and that it comprises all the technical equivalents of the means described and also their combinations if these come within the scope of the invention.

What is claimed is:

1. An antenna with coverage and frequency flexibility, comprising:

a reversible reflector having two separate reflecting surfaces shaped geometrically so as to cover respectively a first and a second geographical zone which are different and have predetermined shapes, wherein the two separate reflecting surfaces are fastened back to back on a common support; and at least two independent sources arranged in a fixed configuration and connected to separate radio-frequency supply chains defining different and predefined operating frequency planes, wherein the reversible reflector has a first deployment position, in which a focal point of a first reflecting surface is located at a phase centre of a first independent source, a second deployment position, in which a focal point of a second reflecting surface is located at a phase centre of a second independent source, a third deployment position, in which the focal point of the first reflecting surface is located at the phase centre of the second independent source, and a fourth deployment position, in which the focal point of the second reflecting surface is located at the phase centre of the first independent source.

2. The antenna according to claim 1, further comprising:

means for deploying the reversible reflector including at least one first motor; and means for reversing the reversible reflector including at least one second motor, wherein the at least one first motor and the at least one second motor have axes of rotation perpendicular to one another, the at least one second motor actuating a reversal of the reversible reflector from the first deployment position to the second deployment position by means for rotating of the common support through a predetermined angle.

3. The antenna according to claim 2, further comprising:

means for translating the reversible reflector, including at least one third motor connected to the at least one first motor and to the at least one second motor by means for levering, wherein the at least one third motor having an axis of rotation parallel to an axis of rotation of the at least one first motor, the at least one first motor and the at least one third motor actuate the reversible reflector in translation making it possible to change a position of the focal point of the first reflecting surface or of the second reflecting surface from the first independent source to the second independent source.

4. The antenna according to claim 1, wherein the at least two independent sources are fastened side by side or one above the other.

5. The antenna according to claim 1, wherein a telecommunication satellite includes the antenna.

* * * * *